US008109790B2

(12) United States Patent
He et al.

(10) Patent No.: US 8,109,790 B2
(45) Date of Patent: Feb. 7, 2012

(54) ELECTRICAL CONNECTOR WITH IMPROVED MOUNTING PORTION

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 128 days.

(21) Appl. No.: 12/729,835

(22) Filed: Mar. 23, 2010

(65) Prior Publication Data

US 2010/0240255 A1 Sep. 23, 2010

(30) Foreign Application Priority Data

Mar. 23, 2009 (CN) ..... 2009 2 0301534

(51) Int. Cl.
*H01R 13/648* (2006.01)

(52) U.S. Cl. ..... 439/607.35

(58) Field of Classification Search .. 439/607.35–607.4, 439/607.23–607.24, 607.54
See application file for complete search history.

(56) References Cited

U.S. PATENT DOCUMENTS 3,005,174 A * 10/1961 Pifer ..... 439/607.59
4,433,886 A * 2/1984 Cassarly et al. ..... 439/65
5,030,140 A * 7/1991 Sugiyama ..... 439/607.35
5,035,650 A * 7/1991 Defibaugh et al. ..... 439/607.17
5,241,453 A * 8/1993 Bright et al. ..... 361/704
5,697,799 A * 12/1997 Consoli et al. ..... 439/181
5,993,258 A * 11/1999 Matsunuma et al. .... 439/607.04
6,050,852 A * 4/2000 Wu ..... 439/607.02
6,086,421 A * 7/2000 Wu et al. ..... 439/607.35
6,093,046 A * 7/2000 Chiou et al. ..... 439/378
6,113,427 A * 9/2000 Wu ..... 439/607.47
6,152,773 A * 11/2000 Chen ..... 439/607.01
6,322,394 B1 * 11/2001 Katoh et al. ..... 439/607.11
6,375,505 B1 * 4/2002 Lin ..... 439/607.37
6,439,901 B1 * 8/2002 Ji et al. ..... 439/135
6,475,033 B1 11/2002 Zhu et al.
6,478,623 B1 * 11/2002 Wu ..... 439/607.35
6,485,328 B1 * 11/2002 Wu ..... 439/567
6,663,402 B1 * 12/2003 Yu ..... 439/108
6,749,463 B1 * 6/2004 Fan ..... 439/607.23
7,077,680 B1 * 7/2006 Wang et al. ..... 439/331
7,108,554 B2 * 9/2006 Huang ..... 439/607.01
7,445,502 B2 * 11/2008 Zhang ..... 439/607.01
7,682,159 B2 * 3/2010 Huang et al. ..... 439/71
7,744,382 B2 * 6/2010 Zheng et al. ..... 439/79
7,811,110 B2 * 10/2010 He et al. ..... 439/218
7,811,131 B2 * 10/2010 Wang et al. ..... 439/607.35
7,883,370 B2 * 2/2011 Ting et al. ..... 439/607.35
7,997,922 B2 * 8/2011 Dawiedczyk et al. ..... 439/357

* cited by examiner

*Primary Examiner* — Neil Abrams
(74) *Attorney, Agent, or Firm* — Wei Te Chung; Andrew C. Cheng; Ming Chieh Chang

(57) ABSTRACT

An electrical connector (100) includes an insulative housing (1) having a base (11) and a tongue plate (12) extending beyond the base; a set of contacts (2) retained in the insulative housing; and a metal shell (3) covering the insulative housing. The metal shell includes a pair of first walls (31), a pair of second walls (32) including a front wall and a back wall, and a receiving space (33) surrounded by the first walls and the second walls. The first walls have a pair of first mounting portion (315) for being mounted onto first holes of the PCB. The front wall has a pair of jointing walls (326) extending toward each other from the respective front sides of the first walls and combining with each other at a joint. The front wall has a pair of mounting legs (325) extending from the jointing walls at the joint and forming as a second mounting portion (35) for being mounted onto a second hole of the PCB.

17 Claims, 5 Drawing Sheets

ELECTRICAL CONNECTOR WITH IMPROVED MOUNTING PORTION

BACKGROUND OF THE INVENTION

1. Field of the Invention

The present invention relates to an electrical connector, and more particularly to electrical connectors having mounting portions for being mounted onto a printed circuit board (PCB).

2. Description of Related Art

A conventional electrical connector usually have many different types for being mounted on a PCB such as right angle type, upright type, and vertical type. A vertical type electrical connector usually comprises an insulative housing, a plurality of contacts retained in the insulative housing, and a metal shell covering the insulative housing and defining a receiving space for receiving a complementary plug. The insulative housing includes a base resist the PCB, and a tongue plate extending upwardly from the base into the receiving space. The contacts having contacting portions retained in the tongue plate for mating with the plug. The shell has a pair of first walls covering two lateral sides of the insulative housing and a pair of second walls connecting the first walls. The first walls and the second walls form the receiving space together. Each first wall has a mounting portion extending downwardly from a lower end thereof and extending along the first wall for being mounted onto the PCB.

The mounting portions are parallel to each other and are mounted onto holes of the PCB so as to firm the shell on the PCB. However, when the parallel mounting portion are mounted onto the PCB, the shell will have a vibration along a transverse direction easily.

Hence, an improved electrical connector with an improved contacts arrangement is desired to overcome the above problems.

BRIEF SUMMARY OF THE INVENTION

According to one aspect of the present invention, an electrical connector for being mounted on a PCB comprises: an insulative housing having a base and a tongue plate extending upwardly beyond the base; a plurality of contacts retained in the insulative housing; and a metal shell covering the insulative housing, the metal shell including a pair of first walls covering two lateral sides of the insulative housing, a pair of second walls including a front wall connecting two front sides of the first walls and a back wall connecting two back sides of the first walls, and a receiving space surrounded by the first walls and the second walls for receiving the tongue plate therein, the first walls having a pair of first mounting portion extending downwardly from respective lower ends thereof for being mounted onto first holes of the PCB, the front wall having a pair of jointing walls extending toward each other from the respective front sides of the first walls and combining with each other at a joint; wherein the front wall has a pair of mounting legs extending from the respective jointing walls at the joint and forming as a second mounting portion for being mounted onto a second hole of the PCB.

According to another aspect of the present invention, a vertical electrical connector for being perpendicularly mounted on a PCB comprises: an insulative housing having a base and a tongue plate extending upwardly beyond the base; a plurality of contacts retained in the insulative housing; and a metal shell covering the insulative housing. The metal shell comprises: a pair of first walls covering two lateral sides of the insulative housing; a pair of second walls including a front wall connecting two front sides of the first walls and a back wall connecting two back sides of the first walls, the front wall having a pair of jointing walls extending toward each other from the respective front sides of the first walls and combining with each other at a joint; a receiving space surrounded by the first walls and the second walls for receiving the tongue plate therein; a pair of first mounting portions extending downwardly along the first walls for being mounted onto the PCB; and a second mounting portion including a pair of mounting legs extending from the respective jointing walls at the joint and parallel to the first mounting portions for being mounted onto the PCB. Wherein the second mounting portion is located at the front of the front wall, the first mounting portions and the second mounting portion form an isosceles triangle, the distances between the second mounting portion and each of the first mounting portions are essentially equal.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
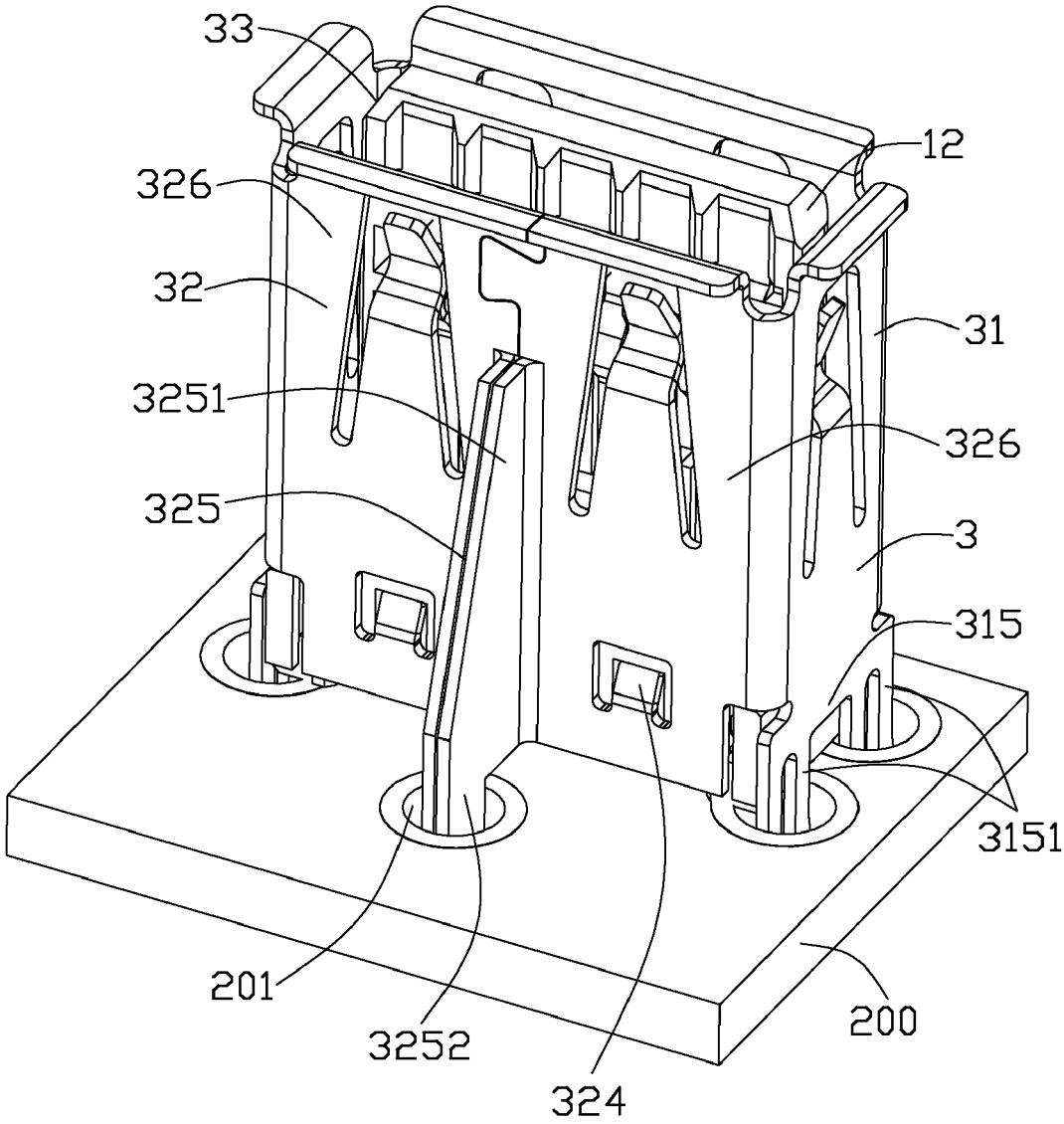
FIG. 1 is a perspective view of an electrical connector mounted on a PCB according to the present invention.
Figure 2:
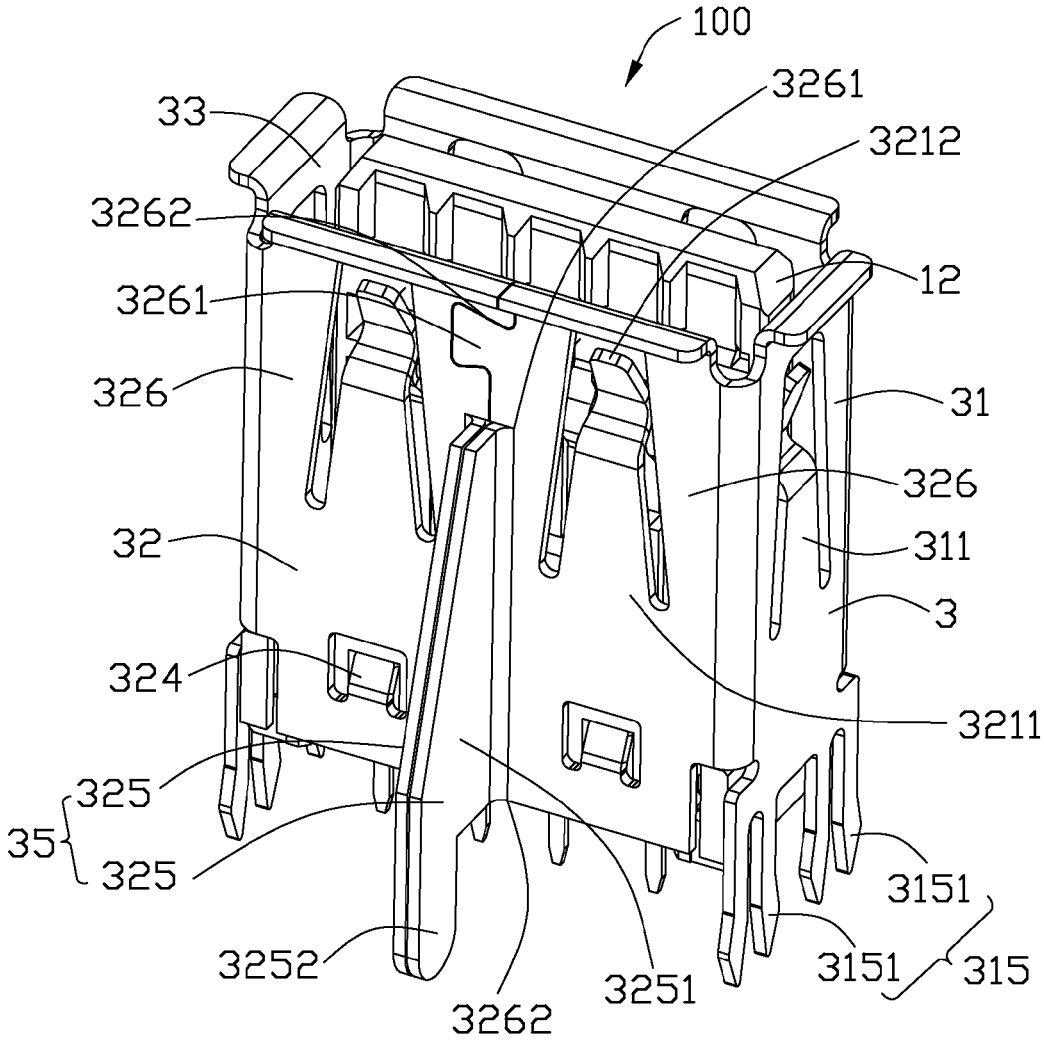
FIG. 2 is a perspective view of the electrical connector shown in FIG. 1.
Figure 3:
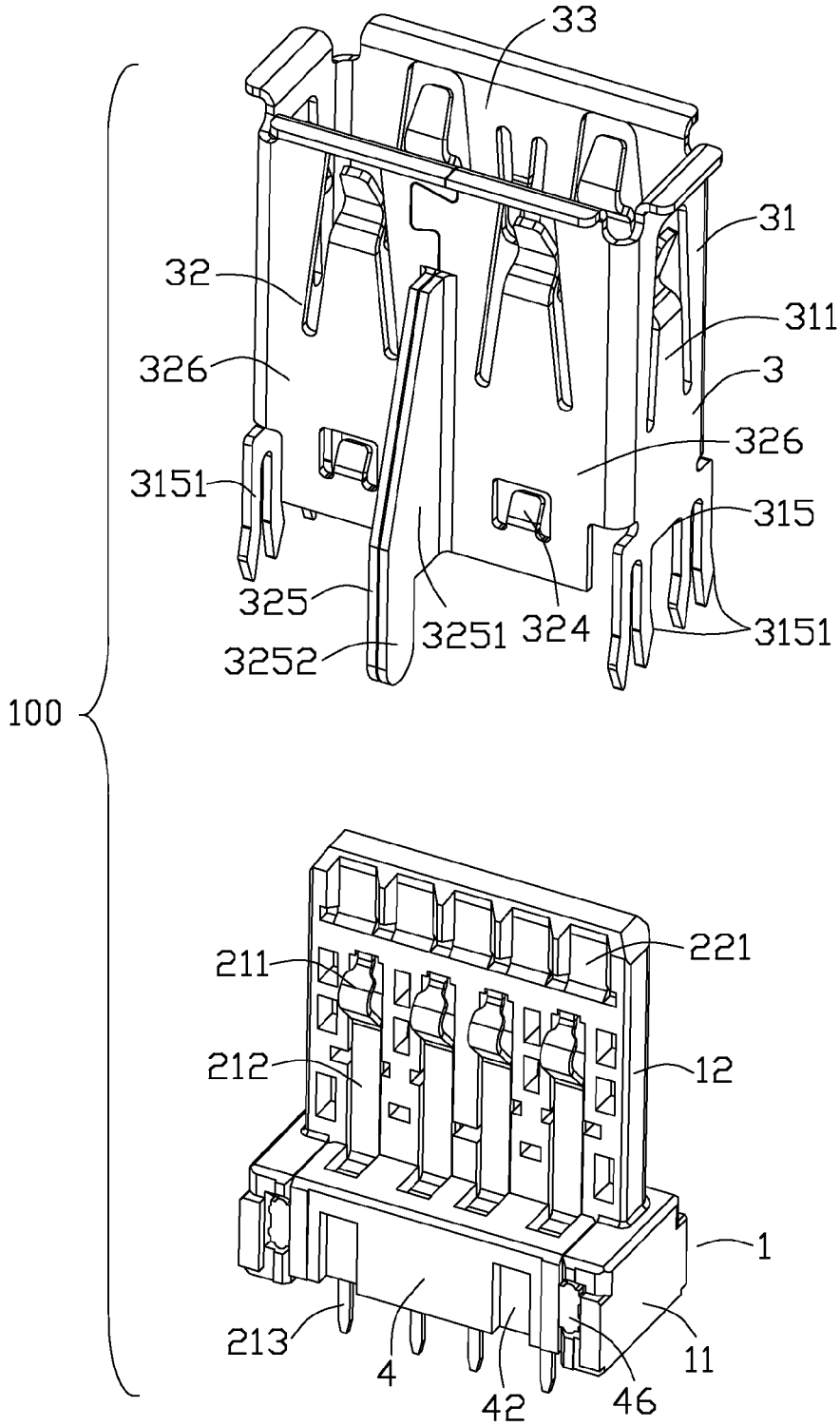
FIG. 3 is a partly exploded view of the electrical connector shown in FIG. 1.
Figure 4:
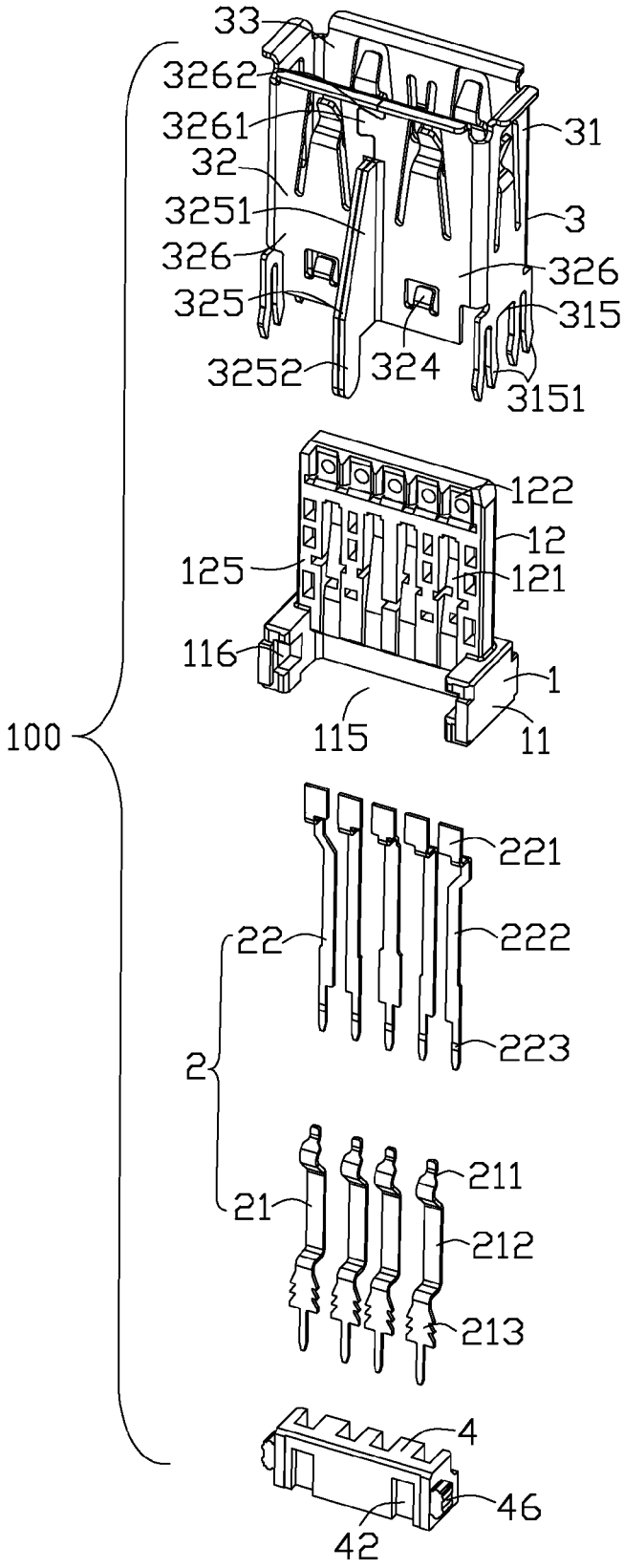
FIG. 4 is an exploded view of the electrical connector shown in FIG. 1.
Figure 5:
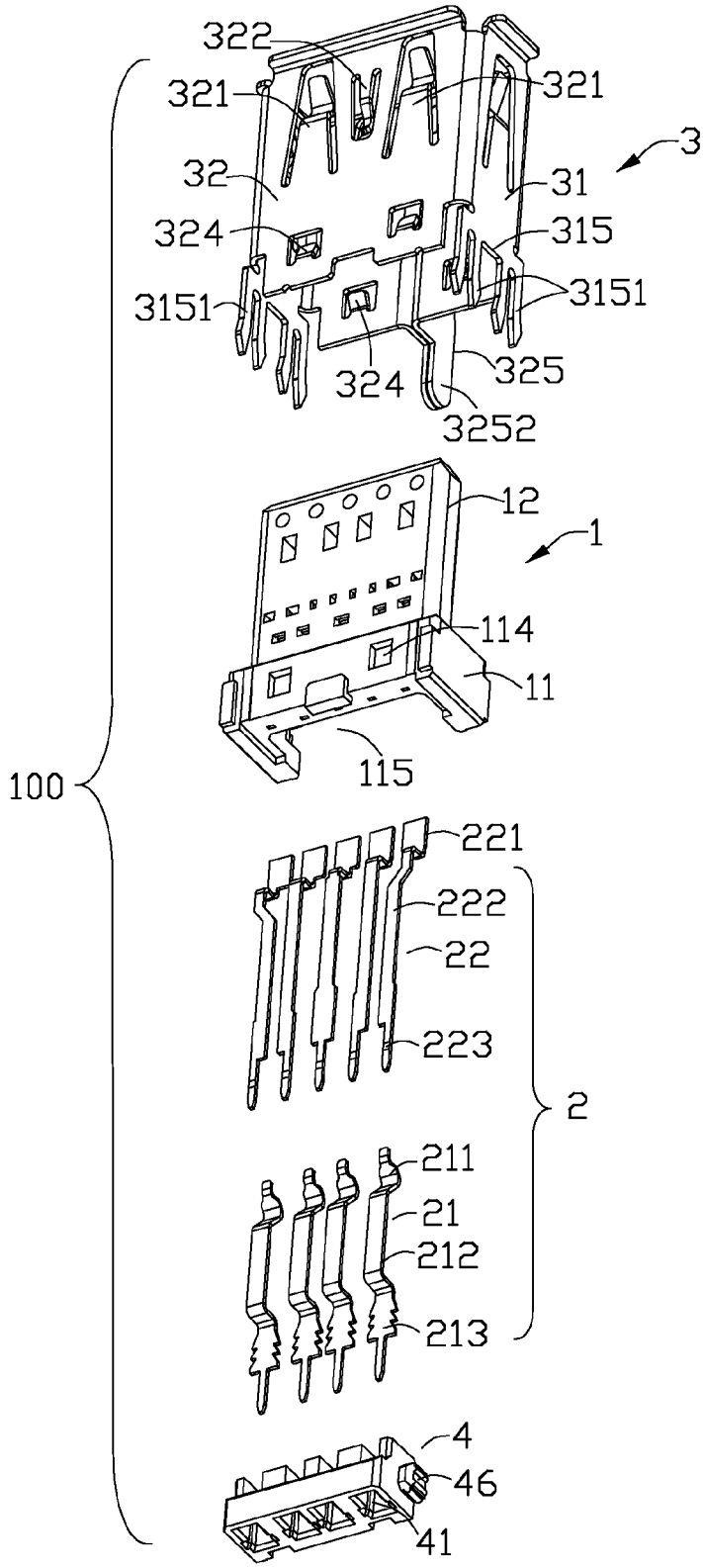
FIG. 5 is another exploded view of the electrical connector shown in FIG. 1.

Referring to FIGS. 1, 4 and 5, a vertical electrical connector 100 according to the present invention for being mounted on a printed circuit board (PCB) 200 is disclosed. The electrical connector 100 is preferable a A-type USB 3.0 socket and includes an insulative housing 1, a plurality of contacts 2 retained in the insulative housing 1 and being configured to carry USB 3.0 signals, a spacer 4 coupled to the insulative housing 1, and a metal shell 3 covering the insulative housing 1 and the spacer 4. The metal shell 3 defines a receiving space 33 for receiving a complementary plug (not shown) which mates with the electrical connector 100. In this embodiment, the electrical connector 100 extend along an up-to-down direction perpendicular to the PCB 200. In other embodiment, the electrical connector 100 could extend along an up-to-down direction at an acute angle with respective to the PCB 200.

Referring to FIGS. 4 and 5, the insulative housing 1 is molded of dielectric material such as plastic or the like, and has a base 11 and a tongue plate 12 integrally extending upwardly from an upper face of the base 11 into the receiving space 33. In another embodiment, the base 11 and the tongue plate 12 could be molded separately and assembled together to form the insulative housing 1. The base 11 has a recess 115 recessed backwardly from a front face thereof, and a pair of grooves 116 located at two lateral sides of the recess 115. The base 11 has a pair of cavities 114 recessed forwardly from a back face thereof. The tongue plate 12 has a set of first receiving slots 121 recessed backwardly from a front face 125 thereof and arranged in one row located on a lower position thereof, and a set of second receiving slots 122 recessed backwardly from the front face 125 and arranged in another row located on an upper position thereof.

The contacts 2 include a set of first contacts 21 being configured to carry USB 2.0 signals and a set of second contacts 22. Each first contact 21 has a resilient first contacting portion 211 received in the first receiving slot 121 and protruding beyond the front face 125 of the tongue plate 12, a first tail portion 213 extending downwardly beyond the base 11 for being mounted to the PCB 200, and a first retaining portion 212 connecting the first contacting portion 211 and the first tail portion 213. Each second contact 22 has a stiff second contacting portion 221 received in the second receiving slot 122 and located behind the front face 125 of the tongue plate 12, a second tail portion 223 extending downwardly beyond the base 11 for being mounted to the PCB 200, and a second retaining portion 222 connecting the second contacting portion 221 and the second tail portion 223 and retained in the insulative housing 1. The first contacting portion 211 protrudes into the receiving space 33. The second contacting portion 221 is exposed to the receiving space 33. Therefore, both the first contacting portion 211 and the second contacting portion 221 are located on a front side of the tongue plate 12, and the second contacting portion 221 is located above the first contacting portion 211. In another embodiment, the second contacting portion 221 and the second retaining portion 222 could be insert molded into the insulative housing 1.

The spacer 4 is assembled into the recess 115 of the base 11. The spacer 4 has a pair of protrusions 46 protruding from two lateral sides thereof for being retained in the respective grooves 116. The spacer 4 has a set of through holes 41 for the first tail portions 213 passing through and a pair of cavities 42 recessed backwardly from a front face thereof. In this embodiment, the first tail portions 213 are assembled to the through holes 41 of the spacer 4 so as to be retained in the spacer 4. In another embodiment, the first tail portions 213 could be insert molded into the spacer 4.

The metal shell 3 has a pair of first walls 31 enveloping two lateral sides of the insulative housing 1 and parallel to each other, and a pair of second walls 32 including a front wall connecting front sides of the respective first walls 31 and a back wall connecting back sides of the respective first walls 31. The front wall and the back wall are parallel to each other. The first walls 31 and second walls 32 form the receiving space 33. The receiving space has an upper opening communicating with an exterior for the complementary plug inserting therein. Each first wall 31 has a first mounting portion 315 extending downwardly from a lower end thereof. The first mounting portion 315 includes a pair of board locks 3151 for being mounted onto holes 201 of the PCB so as to firm the metal shell 3 onto the PCB 200 reliably. Each board lock 3151 has a pair of legs (not labeled) for being mounted onto the same hole 201 of the PCB. Each of the front wall and the back wall has a pair of first spring tabs 321 extending upwardly and protruding into the receiving space 33 for pressing against the complementary plug. At the front wall, each first spring tab 321 has a lower edge 3211 connecting to the front wall and an upper free end 3212, the first spring tab 321 extends upwardly from the lower edge 3211 and protrudes into the receiving space 33, the extending portion 3251 extends from an upper end 3261 of the jointing wall 326 located above the lower edge 3211 to a bottom edge 3262 of the jointing wall 326. The back wall further has a second spring tab 322 extending downwardly and protruding into the receiving space 33 for pressing against the complementary plug. At the back wall, the second spring tab 322 is located between the first spring tabs 321. Each of the first walls 31 has a third spring tab 311 extending upwardly and protruding into the receiving space 33 for pressing against the complementary plug. Therefore, when the complementary plug is inserted into the electrical connector 100, the first, second and third spring tabs 321, 322, 311 press against the plug so as to firm the plug reliably. Each of the back wall and the front wall has a pair of latching tabs 324 latching into the respective cavities 114, 42 of the insulative housing 1 and the spacer 4 to firm the metal shell 3 on the insulative housing 1 and the spacer 4. The latching tabs 324 locate at two sides of the second mounting portion 35.

The front wall of the second walls 32 includes a pair of jointing walls 326 extending toward each other from the respective front sides of the first walls 31 and combining with each other at a joint. The jointing walls 326 has a latching portion 3261 and a cutout portion 3262 for latching with each other at the joint. A pair of mounting legs 325 extend from the respective jointing walls 326 at the joint and form as a second mounting portion 35 for being mounted onto a hole 201 of the PCB 200. Each mounting leg 525 has an extending portion 3251 extending forwardly and vertically from the respective jointing wall 326 at the joint and a securing portion 3252 extending downwardly from the extending portion 3251 for being mounted onto the hole 201 of the PCB 200. The second mounting 325 is located at the front of the first mounting portions 315 and the first mounting portions 315, and is parallel to the first mounting portions 315. The first mounting portions 315 and the second mounting portion 35 form an isosceles triangle. The distances between the second mounting portion 35 and each of the first mounting portions 315 are essentially equal.

The first mounting portions 315 and the second mounting portion 35 form an isosceles triangle and are mounted onto the PCB 200 so as to prevent the electrical connector 100 from vibrating along a front-to-back direction and a transverse direction perpendicular to the front-to-back direction. Therefore, the first mounting portions 315 and the second mounting portion 35 could firm the electrical connector 100 onto the PCB 200 more reliably. Furthermore, the second mounting portion 35 has two mounting legs 325 extending from the respective jointing walls 326 at the joint and being mounted onto the same hole 201 of the PCB 200 so as to prevent the jointing walls 326 from breakage or splitting.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted on a PCB comprising:

an insulative housing having a base and a tongue plate extending upwardly beyond the base;

a plurality of contacts retained in the insulative housing; and a metal shell covering the insulative housing, the metal shell including a pair of first walls covering two lateral sides of the insulative housing, a pair of second walls including a front wall connecting two front sides of the first walls and a back wall connecting two back sides of the first walls, and a receiving space surrounded by the first walls and the second walls for receiving the tongue plate therein, the first walls having a pair of first mounting portion extending downwardly from respective lower ends thereof for being mounted onto first holes of the PCB, the front wall having a pair of jointing walls extending toward each other from the respective front sides of the first walls and combining with each other at a joint; wherein the front wall has a pair of mounting legs extending from the respective jointing walls at the joint and forming as a second mounting portion for being mounted onto a second hole of the PCB.

2. The electrical connector according to claim 1, wherein each mounting leg has an extending portion extending forwardly from the respective jointing wall at the joint and a securing portion extending downwardly from the extending portion for being mounted onto the second hole of the PCB, the second mounting portion is located at the front of the first mounting portions.

3. The electrical connector according to claim 2, wherein the first mounting portions and the second mounting portion form an isosceles triangle, the distances between the second mounting portion and each of the first mounting portions are essentially equal.

4. The electrical connector according to claim 2, wherein the front wall has a pair of first spring tabs each having a lower edge connecting to the front wall, the first spring tab extends upwardly from the lower edge and protrudes into the receiving space, the extending portion extends from an upper end of the jointing wall located above the lower edge to a bottom edge of the jointing wall.

5. The electrical connector according to claim 1, wherein the jointing walls have a latching portion and a cutout portion for latching with each other at the joint.

6. The electrical connector according to claim 1, wherein each first mounting portion includes a pair of board locks for being mounted onto the different first holes of the PCB, each board lock has a pair of legs for being mounted onto the same first hole of the PCB.

7. The electrical connector according to claim 1, wherein the contacts are configured as USB 3.0 contacts, the contacts include a set of first contacts and a set of second contacts, each first contact has a resilient first contacting portion retained in the tongue plate and protruding beyond a front face of the tongue plate, a first tail portion extending downwardly beyond the base for being mounted onto the PCB, and a first retaining portion connecting the first contacting portion and the first tail portion, each second contact has a stiff second contacting portion retained in the tongue plate and located behind the front face of the tongue plate, a second tail portion extending downwardly beyond the base for being mounted onto the PCB, and a second retaining portion connecting the second contacting portion and the second tail portion and retained in the insulative housing, the first contacting portion protrudes into the receiving space, the second contacting portion is exposed to the receiving space, the second contacting portion is located above the first contacting portion.

8. The electrical connector according to claim 7, wherein the electrical connector further comprises a spacer coupled to the insulative housing and covered by the metal shell, the spacer has a set of through holes for the first tail portions passing through.

9. The electrical connector according to claim 8, wherein the base has a pair of cavities recessed forwardly from a back face thereof, the spacer has a pair of cavities recessed backwardly from a front face thereof, the front wall of the metal shell has a pair of latching tabs latching into the respective cavities of the spacer, the back wall of the metal shell has a pair of latching tabs latching into the respective cavities of the insulative housing.

10. The electrical connector according to claim 1, wherein the back wall has a pair of first spring tabs extending upwardly and protruding into the receiving space, and a second spring tab extending downwardly and protruding into the receiving space, the second spring tab is located between the first spring tabs.

11. A vertical electrical connector for being perpendicularly mounted on a PCB comprising:

an insulative housing having a base and a tongue plate extending upwardly beyond the base;

a plurality of contacts retained in the insulative housing; and a metal shell covering the insulative housing, the metal shell comprising:

a pair of first walls covering two lateral sides of the insulative housing;

a pair of second walls including a front wall connecting two front sides of the first walls and a back wall connecting two back sides of the first walls, the front wall having a pair of jointing walls extending toward each other from the respective front sides of the first walls and combining with each other at a joint;

a receiving space surrounded by the first walls and the second walls for receiving the tongue plate therein;

a pair of first mounting portions extending downwardly along the first walls for being mounted onto the PCB; and a second mounting portion including a pair of mounting legs extending from the respective jointing walls at the joint and parallel to the first mounting portions for being mounted onto the PCB; wherein the second mounting portion is located at the front of the front wall, the first mounting portions and the second mounting portion form an isosceles triangle, the distances between the second mounting portion and each of the first mounting portions are essentially equal.

12. The electrical connector according to claim 11, wherein each first mounting portion includes a pair of board locks for being mounted onto different holes of the PCB, each board lock has a pair of legs for being mounted onto the same hole of the PCB.

13. The electrical connector according to claim 11, wherein the mounting legs have extending portions extending forwardly from the respective jointing walls at the joint and securing portions extending downwardly from the extending portions for being mounted onto a hole of the PCB.

14. The electrical connector according to claim 11, wherein the jointing walls have a latching portion and a cutout portion for latching with each other at the joint.

15. The electrical connector according to claim 11, wherein the electrical connector is a standard A-type USB 3.0 receptacle.

16. An electrical connector for mounting to a printed circuit board, comprising:

an insulative housing defining an upstanding housing with an upstanding mating port thereof;

a plurality of contacts disposed in the housing with contacting sections exposed in the mating port;

a metallic shell enclosing said housing to defining said upstanding mating port vertically, said shell defining two opposite main walls and two opposite side walls between said man walls and cooperating with said main walls to commonly define said upstanding mating port, each of said side walls defining at least one first mounting portion essentially consisting of a pair of spaced deflectable mounting legs for commonly deflectable reception with a corresponding through hole in the printed circuit board; wherein one of said main walls defines a second mounting portion with at least one mounting leg for mounting into another through hole in the printed circuit board, and said second mounting portion extends upwardly higher than the first mounting portion.

17. The electrical connector as claimed in claim 16, wherein the pair of mounting legs of the first mounting portion is essentially aligned vertically with the corresponding side wall while the mounting leg of the second mounting portion is spaced from the corresponding main wall with a distance along a direction defined by the side wall.

* * * * *